US006412246B1

(12) United States Patent
Tadich

(10) Patent No.: US 6,412,246 B1
(45) Date of Patent: Jul. 2, 2002

(54) STRUCTURAL TRUSS

(75) Inventor: John Tadich, Knoxfield (AU)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/303,027

(22) Filed: Apr. 30, 1999

(30) Foreign Application Priority Data

Apr. 30, 1999 (AU) ..... PP 3268

(51) Int. Cl.[7] ..... E04C 3/04

(52) U.S. Cl. ..... 52/633; 52/639; 52/693; 52/694; 52/712; 52/715; 411/459; 411/460; 411/461; 411/466; 411/467; 411/644; 411/457

(58) Field of Search ..... 52/694, 633, 639, 52/712, 715, 693; 411/461, 466, 467, 457, 460, 459, 644

(56) References Cited

U.S. PATENT DOCUMENTS

| | | | | | |
|---|---|---|---|---|---|
| 3,416,283 | A | * | 12/1968 | Sanford | 52/693 |
| 3,708,942 | A | * | 1/1973 | Leonard | 52/694 |
| 3,867,803 | A | | 2/1975 | Platt | 52/693 |
| 4,143,500 | A | | 3/1979 | Sanford | 52/693 |
| 4,295,318 | A | | 10/1981 | Perlman | 52/693 |
| 4,308,703 | A | | 1/1982 | Knowles | 52/694 |
| 4,475,328 | A | * | 10/1984 | Reeder et al. | 52/693 |
| 4,570,407 | A | * | 2/1986 | Palacio et al. | 52/693 |
| D286,855 | S | * | 11/1986 | Paul | D8/389 |
| 5,457,927 | A | | 10/1995 | Pellock et al. | 52/633 |
| 5,463,837 | A | * | 11/1995 | Dry | 52/639 |
| 5,857,306 | A | | 1/1999 | Pellock | 52/643 |

FOREIGN PATENT DOCUMENTS

| | | | | |
|---|---|---|---|---|
| AU | 53371/69 | | 10/1970 | |
| AU | 56482/69 | | 12/1970 | |
| AU | 689190 | | 9/1995 | |
| AU | A-21418/97 | | 11/1997 | |
| CA | 845915 | * | 7/1970 | 52/639 |
| GB | 2127457 | A | 4/1984 | E04C/3/18 |
| GB | 2313139 | A | 11/1997 | E04C/3/17 |
| ZA | 94/7462 | | 5/1996 | |

* cited by examiner

*Primary Examiner*—Carl D. Friedman
*Assistant Examiner*—Christy M. Green
(74) *Attorney, Agent, or Firm*—Senniger, Powers, Leavitt & Roedel

(57) ABSTRACT

A truss is disclosed which comprises a bottom chord (12) and a pair of top chords (14, 16) arranged obliquely with respect to the bottom chord (12). Webs (20) are arranged between the top chords and the bottom chord. The webs have punched nails (46) projecting from connector plate (40) portions of the webs. The webs have a middle section (30) and load bearing portions (60) are provided between the middle section and the two connector plates (40) at opposite ends of the web (20). The load bearing portions are shaped for blunt end engagement with the chords without regard to the angle of intersection of the web with the chord.

29 Claims, 3 Drawing Sheets

STRUCTURAL TRUSS

BACKGROUND OF THE INVENTION

This invention relates generally to structural trusses and more particularly to trusses formed by chords and webs interconnecting the chords.

Structural trusses, and particularly those used for supporting the roof of residential structures, have traditionally been made of wood. Typically, the trusses have a bottom chord and top chords which define the peripheral shape of the truss. These chords are strengthened and rigidified by webs extending between the bottom chord and respective top chords. The price of wood has risen to the point where other materials such as steel become practical as materials for truss fabrication. A truss fabricated of metal components is shown in coassigned U.S. Pat. No. 5,457,927. It is also known to use metal webs in combination with wooden chords, such as shown for flat trusses in coassigned U.S. Pat. No. 4,475,328.

Steel truss components must be formed into shapes which permit their use in place of the traditional wooden components. The simpler and more standard the formation of the components, the greater the savings realized. However, standardization of the components is made difficult, because trusses come in many different sizes and shapes. The webs extend between the chords in different arrangements, and therefore intersect the chords at different angles. However, the webs must have the ability to be connected to the chords and they must be able to accept loads from the chords regardless of their angle of intersection.

SUMMARY OF THE INVENTION

Among the several objects and features of the present invention may be noted the provision of a truss which employs metallic components; the provision of such a truss which has components of standard design for use in different configurations; the provision of such a truss which has metal webs capable of use with wooden chords; the provision of such webs which bear loads without regard to their angle of intersection with the chords they engage; and the provision of such a truss which is economical to manufacture.

Also among the several objects and features of the present invention may be noted the provision of a metal web member which achieves the foregoing objects.

Generally, a truss of the present invention comprises a bottom chord and at least one top chord connected to the bottom chord. Webs are arranged between the bottom chord and the top chord and intersect the top and bottom chords at oblique angles. The webs have load bearing portions at each end thereof engaging the bottom and top chords. The load bearing portions each are shaped for blunt end engagement with its respective chord without regard to the angle of intersection of the web with the chord.

In another aspect to the present invention, a metal web for use in a truss to interconnect a top chord with a bottom chord of the truss comprises an elongate, generally channel shaped middle section including side walls and a bottom wall. Load bearing portions at each end of the middle section are capable of engaging the bottom and top chords, respectively. The load bearing portions each are shaped for blunt end engagement with a respective chord without regard to the angle of intersection of the web with the chord.

Other objects and features of the present invention will be in part apparent and in part pointed out hereinafter.

DESCRIPTION OF THE DRAWINGS

Corresponding reference characters indicate corresponding parts throughout the several views of the drawings.

DESCRIPTION OF THE PREFERRED EMBODIMENTS

Figure 1:
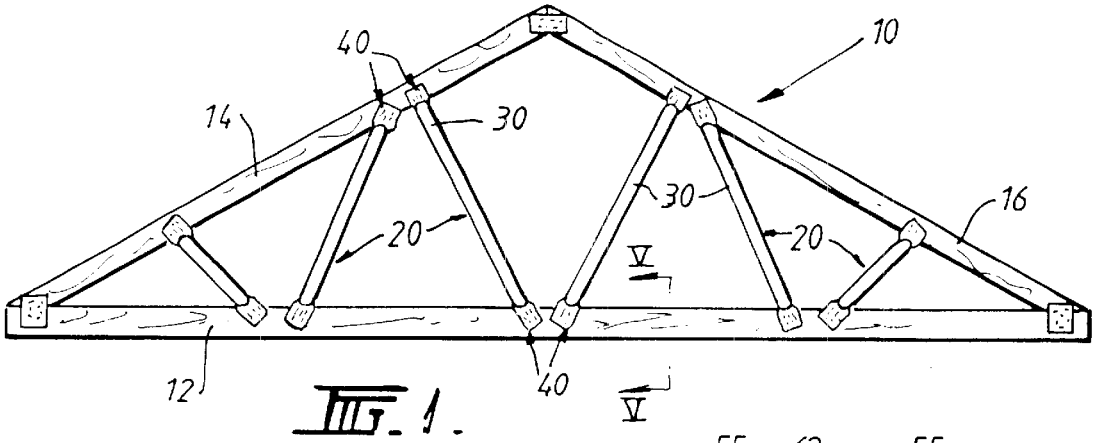
FIG. 1 is view of the truss embodying the invention.

FIG. 1 shows a roof truss 10 which is generally conventional in appearance having a bottom chord 12 and a pair of obliquely arranged top chords 14 and 16. The chords 12,14 and 16 may be coupled together by connector plates having punched teeth projecting from the plates as is well known. Each plate is pressed or otherwise forced into adjacent chords so that the teeth penetrate the (typically wooden) chords and thereby join the chords together.

The truss 10 has a plurality of webs 20 interconnecting the bottom chord 12 and the top chords 14 and 16, and providing strength and rigidity to the truss. At least some but preferably all of the webs 20 are formed from metal and are of the desired length to extend between the bottom chord 12 and top chords 14 and 16 as shown in FIG. 1. As is shown in FIG. 1, a number of webs 20 of different lengths will be required in order to complete the truss 10.

Figure 2:
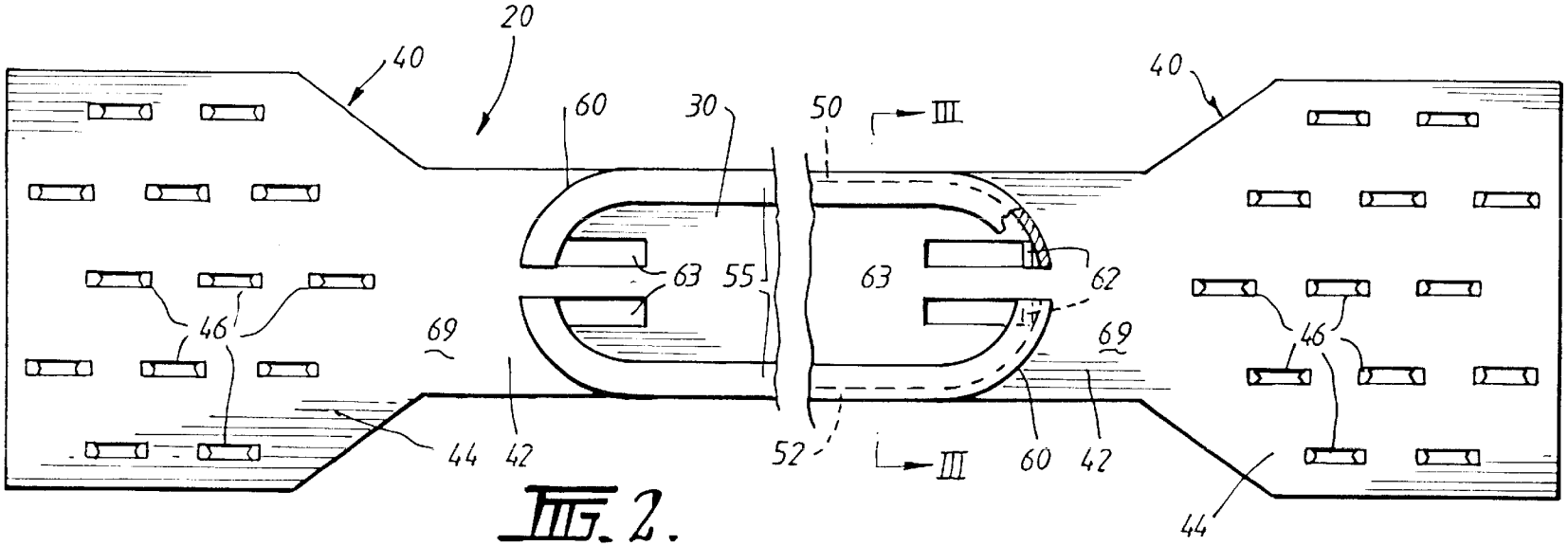
FIG. 2 is a plan view of a web used in the truss of FIG. 1.
Figure 4:
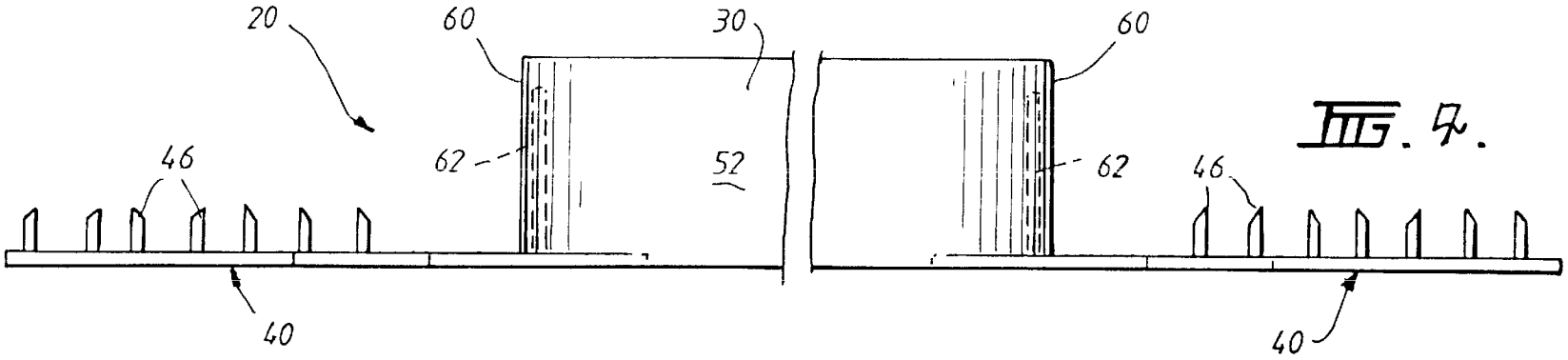
FIG. 4 is a side view of the web of FIG. 2.

A web 20 is shown in FIG. 2 and comprises a middle section 30 which is of the desired length to span the space between the bottom chord 12 and one of the top chords 14 and 16 at the required location of the web 20. Arranged at the ends of the middle section 30 are a pair of connector plates 40 which have an outwardly tapering section 42 and a generally wide end 44. The generally wide end 44 has a plurality of teeth 46 punched from the connector plate 40 to form a nail connector plate for connecting the web 20 between the chords 12 and 14 or 16. The connector plates are preferably integral with the middle section 30 but could comprise separate parts which are riveted, welded or otherwise attached to the middle section 30.

Figure 3:
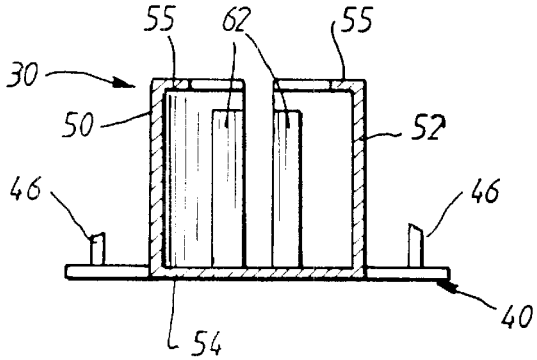
FIG. 3 is a cross-sectional view along the line III—III of FIG. 1.

The chords 12, 14 and 16 are formed from wood as is conventional and as is best shown in FIG. 3 the central section 30 is of generally channel shaped cross-section having side walls 50 and 52 and a bottom wall 54. The connector plates 40 are integral with the bottom wall 54 and the side walls 50 and 52 may be formed by folding or bending a flat blank of material to form the central section 30. The middle section 30 has inwardly turned flanges 55 at the free longitudinal edge margins of the walls 50 and 52 in generally opposed relation to the bottom wall 54. The middle section 30 terminates at each end in a generally curved wall sections 60 which defines generally semicircular ends to the central section 30.

The curved wall sections 60 are formed by making a cut, in a lengthwise direction of the web at the lower part of walls 50 and 52 adjacent connector plates 40. The ends of the walls 50 and 52 cut free from the bottom wall 54 are bent into the curved shape shown in FIG. 2 to form the curved wall sections 60. Thus, the curved wall sections 60 are a continuation of the side walls 50 and 52 at each end of the middle section 30. The curved wall section 60 are shaped for blunt end engagement with the chords 12, 14, 16 without regard to the angle of intersection. Thus, the same configuration of the wall section 60 will work for all of the webs 20 in the truss.

A pair of tabs 62 are punched out of the bottom wall 54 adjacent the ends of the curved wall sections 60 so as to stand up against the end of the wall section 60 or the inside of the wall sections 60 to strengthen the curved wall sections 60. The tab 62, after being punched from the bottom wall 54, leaves slots 63 in the bottom wall 54 as shown in FIG. 2. It is envisioned that additional tabs (not shown) could be provided to engage the curved wall sections 60 and provide more support.

Figure 5:
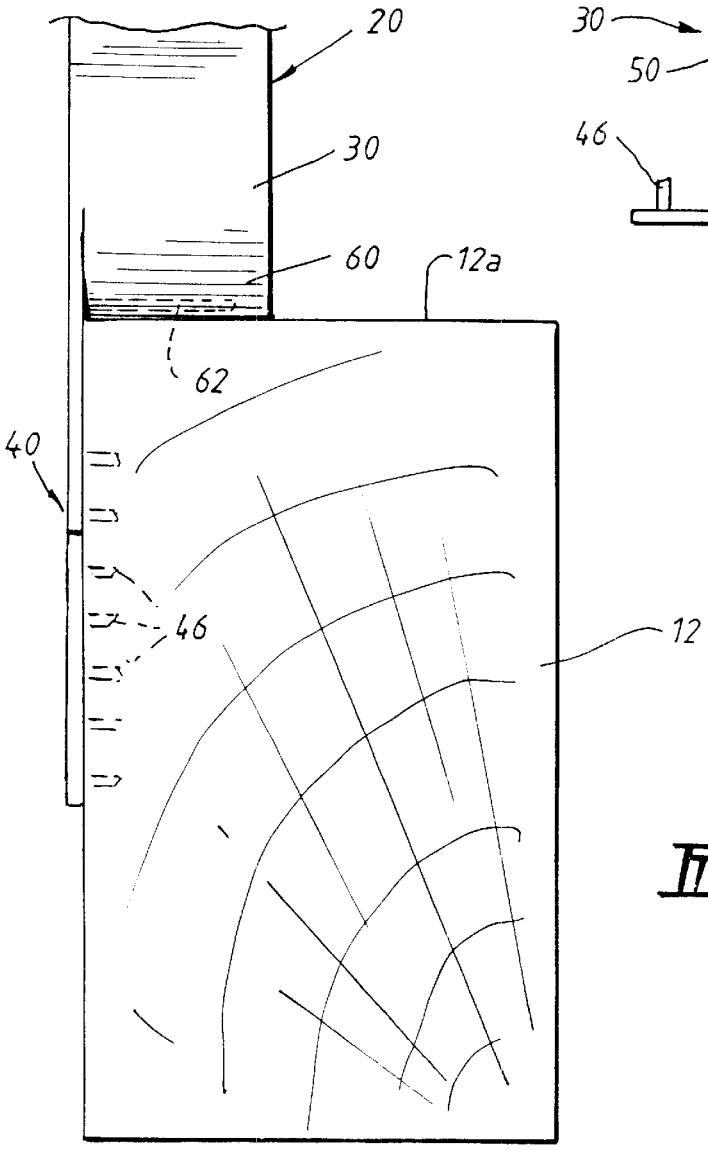
FIG. 5 is a cross-sectional view along the line v—v of FIG. 1.

As is apparent from FIGS. 1 and 5, the web 20 is applied between the chords 12 and 14 by hammering or pressing (in a pressing machine which is not shown) one of the connector plates 40 into the bottom chord 12 and the other connector plate 40 into the top chord 14. Channel shaped middle section 30 is arranged so it is inward of the perimeter of the chords 12 and 14.

As shown in FIG. 5, the curved wall section 60 contacts an upper surface 12*a* of the chord 12 and enables the web 20 to be angled within the inside angle with respect to the chord 12 for connection between the chords 12 and 14. The other end of the web 20 is connected in the same manner. The shape of the connector plates 40, and in particular their width in excess of the width of the middle section 30, assures that a substantial number of teeth 46 will overlie the chord (12, 14, or 16) no matter what the angle of intersection of the web 20 with the chord. The curved wall section 60 contacts the upper web 14 or 16 so that when the truss is installed and load is applied to the truss, the curved wall section 60, which is reinforced by one of the tabs 62, takes the load applied to the truss. The wall section 60 and associated tab 62 form a load bearing portion so that the load is directly transmitted from the chords 12 and 14 or 16 into the middle section 30 and no substantial load is taken by the neck portion 69 of the web 20 which forms a transition from the middle section 30 to the connector plates 40.

As shown in FIG. 5, the webs 20 have a depth (corresponding generally to the height of the side walls 50, 52) which is less than 50% of the width of the chords 12. The depth of the webs 20 is also less than 50% of the width of the chords 14 and 16. Thus, webs 20 can be arranged in pairs on both sides of the truss between the chords 12, 14, 16 and also can overlap or cross one another. This increases the number of web arrangements which can be included in the truss and various different web patterns can be utilized therefore increasing the flexibility of the truss design and location and positioning of the webs 20 within the truss 10.

Figure 6:
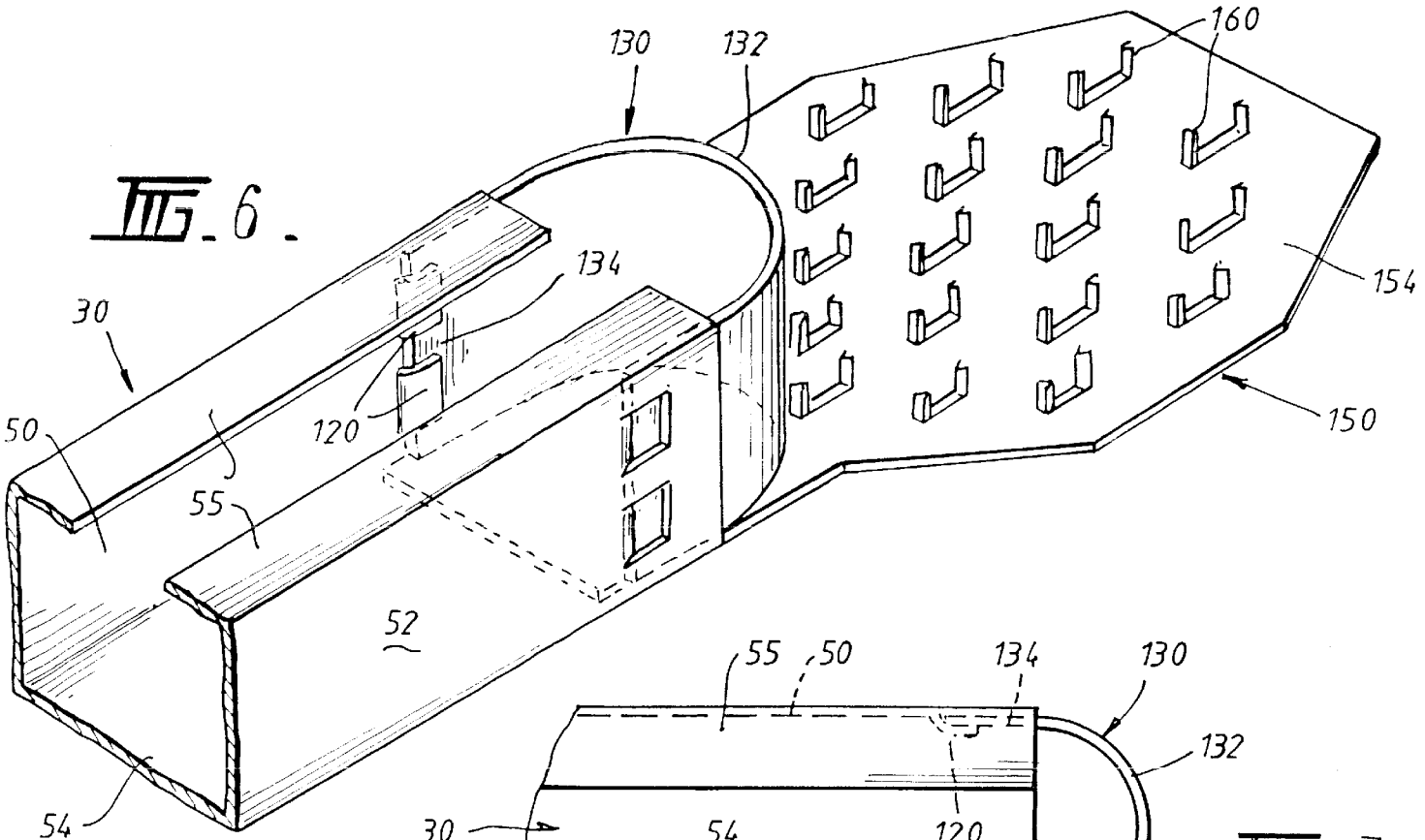
FIG. 6 is a view of a further embodiment of the invention.
Figure 7:
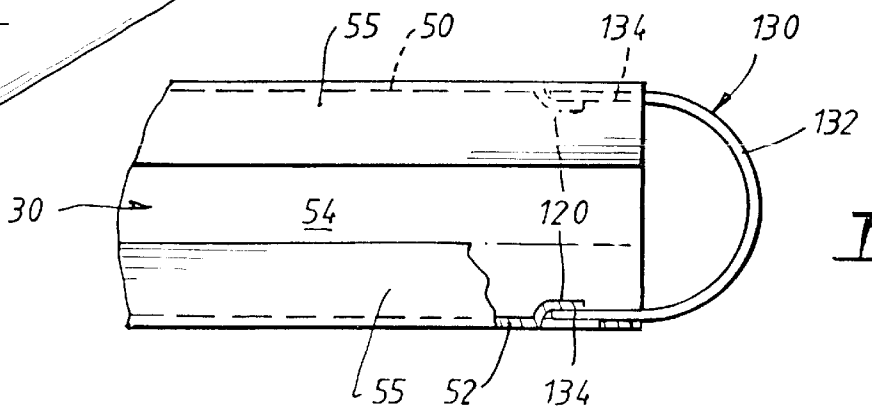
FIG. 7 is a plan view of part of the embodiment of FIG. 6.

FIGS. 6 and 7 show a further embodiment of the invention. In this embodiment, middle section 30 (only one end of which is shown in FIGS. 6 and 7) is formed from channel section similar to that in the previous embodiment which has side walls 50 and 52, bottom wall 54 and with in-turned flanges 55. The sides walls 52 and 50 have cleats 120 punched from them and which project inwardly from the side walls 50 and 52 as shown in FIGS. 6 and 7 so as to form a space between the cleats 120 and side walls 52 and 50.

In this embodiment of the invention, a separate load bearing member 130 (broadly, "a wall member insert") is provided which comprises a generally U-shaped wall member having a rounded end 132 and free ends 134. The free ends 134 are spaced apart by a distance slightly less that the distance between the walls 50 and 52 so that free ends 134 can slide into the middle section 30 adjacent the walls 50 and 52 and into the space between the cleats 120 and the walls 50 and 52. Thus, the cleats 120 effectively couple the load bearing member 130 to the middle section 30.

The load bearing member 130 functions in the same manner as the load bearing member formed by the curved wall section 60 in the previous embodiment and abuts the upper or lower chords and takes the load applied to the truss in the same manner as described with reference ti FIGS. 1 to 5 with the load being transmitted to the middle section 30 via the cleats 120.

Connector plates 150 are also formed separate from both the middle section 30 and load bearing member 130. It should be noted that the connector plate 150 is not shown in FIG. 7 for ease of illustration. The connector plate 150 has a tongue 152 which slides between walls 50 and 52 and on bottom wall 54 into the central section 30. The tongue 152 may be secured to the middle section 30 by clenching, riveting or any other suitable method. Cleats similar to the cleats 120 could also be provided on the bottom wall 54 for receiving the tongue 152. The plate 150 has an enlarged portion 154 outwardly of the tongue 154 which carries the punched teeth 160 which are hammered or pressed into the top and bottom chords of the truss to secure the web shown in FIGS. 6 and 7 to the truss.

Those skilled in the art will appreciate that the invention described herein is susceptible to variation and modifications other than those specifically described. It is understood that the invention includes all such variations and modifications which fall within the spirit and scope.

What is claimed is:

1. A truss comprising:

a bottom chord;

at least one top chord connected to the bottom chord and extending at an oblique angle with respect to the bottom chord;

webs arranged between the bottom chord and the top chord and intersecting the top and bottom chords at oblique angles, the webs having an elongate middle section including a side wall and a bottom wall arranged generally perpendicular to the side wall, and load bearing portions at each end thereof engaging the bottom and top chords, the load bearing portions each being shaped for blunt end engagement with its respective chord without regard to the angle of intersection of the web with the chord, the load bearing portions each extending inwardly of the side wall generally across the bottom wall and generally making a right angle with the bottom wall.

2. A truss as set forth in claim 1 wherein the load bearing portions have a generally smooth curved shape.

3. A truss as set forth in claim 2 wherein the load bearing portions have a generally semicircular shape.

4. A truss as set forth in claim 1 wherein the middle section of the web includes another side wall arranged so that the middle section has a channel shape, the load bearing portions comprise curved wall sections defined by ends of the side walls formed to extend inwardly over the bottom wall toward each other.

5. A truss as set forth in claim 4 wherein said load bearing portions further comprise means for transferring loads from the curved wall sections to the middle sections of the webs.

6. A truss as set forth in claim 5 wherein said load transferring means comprises tabs engaging the curved wall sections on opposite sides of the curved wall sections from sides engaging the chords and fixedly attached to the web, the tabs being positioned for resisting loads applied to the load bearing portions from the chord engaged by the load bearing portion.

7. A truss as set forth in claim 6 wherein the tabs are formed as one piece with the bottom wall of the web.

8. A truss as set forth in claim 1 wherein the middle section of the web includes another side wall arranged so that the middle section has a channel shape, the load bearing portions of the web each comprising a wall member insert received in the channel shaped middle section and having a curved surface engaging the chord.

9. A truss as set forth in claim 8 wherein the load bear portions further comprise means for transferring loads from the wall member inserts to the middle section of each web.

10. A truss as set forth in claim 9 wherein said load transferring means comprises cleats engaging the wall member inserts and fixedly attached to the web, the cleats being positioned for resisting loads applied to the load bearing portions from the chord engaged by the load bearing portion.

11. A truss as set forth in claim 10 wherein the cleats are formed as one piece with the side walls of the middle sections of the webs, the cleats receiving edge margins of the wall member inserts.

12. A truss as set forth in claim 1 wherein the webs each comprise connector plates located at the ends of the web, the connector plates having a plurality of punched nails projecting from the connector plate and penetrating the chord engaged by the web end for connecting the web to the chord.

13. A truss as set forth in claim 12 wherein the middle section of the web includes another side wall arranged so that the middle section has a channel shape, the connector plates are formed separately from the webs, each connector plate including a tongue which is received in the channel shaped middle section of the web.

14. A truss as set forth in claim 1 wherein the webs and chords have respective thicknesses, the web thickness being less than one half the thickness of the chords whereby webs can be arranged between the chords in overlapping configuration.

15. A metal web for use in a truss to interconnect a top chord with a bottom chord of the truss, the metal web comprising an elongate, generally channel shaped middle section including side walls and a bottom wall, and load bearing portions at each end of the middle section for engaging the bottom and top chords, respectively, the load bearing portions each extending along a curve generally in a direction from one side wall toward the other side wall, the load bearing portion being shaped for blunt end engagement with a respective chord without regard to the angle of intersection of the web with the chord.

16. A metal web as set forth in claim 15 wherein the load bearing portions have a generally curved shape.

17. A metal web as set forth in claim 16 wherein the load bearing portions have a generally semicircular shape.

18. A metal web as set forth in claim 15 wherein the load bearing portions comprise curved wall sections defined by ends of the side walls formed to extend inwardly over the bottom wall toward each other.

19. A metal web as set forth in claim 18 wherein the load bearing portions further comprise means for transferring loads from the curved wall sections to the middle section of the web.

20. A metal web as set forth in claim 19 wherein said load transferring means comprises tabs engaging the curved wall sections on opposite sides of the curved wall sections from sides positioned for engaging the chords and fixedly attached to the web, the tabs being positioned for resisting loads applied to the load bearing portions from the chord engaged by the load bearing portion.

21. A metal web as set forth in claim 20 wherein the tabs are formed as one piece with the bottom wall of the web.

22. A metal web as set forth in claim 15 wherein the load bearing portions of the web each comprise a wall member insert received in the channel shaped middle section and having a curved surface engaging the chord.

23. A metal web as set forth in claim 22 wherein the load bearing portions further comprise means for transferring loads from the wall member inserts to the middle section of the web.

24. A metal web as set forth in claim 23 wherein said load transferring means comprises cleats engaging the wall member inserts and fixedly attached to the web, the cleats being positioned for resisting loads applied to the load bearing portions from the chords engaged by the load bearing portions.

25. A metal web as set forth in claim 24 wherein the cleats are formed as one piece with the side walls of the middle sections of the web, the cleats receiving edge margins of the wall member inserts.

26. A metal web as set forth in claim 15 further comprising connector plates located at the ends of the web, the connector plates having a plurality of punched nails projecting from the connector plate for penetrating the chords engaged by the web to connect the web to the chords.

27. A metal web as set forth in claim 26 wherein the connector plates are formed separately from the web, each connector plate including a tongue which is received in the channel shaped middle section of the web.

28. A truss as set forth in claim 1 further comprising tabs engaging the curved wall sections on opposite sides of the curved wall sections from sides engaging the chords and fixedly attached to the web, the tabs being positioned for resisting loads applied to the load bearing portions from the chord engaged by the load bearing portion.

29. A metal web as set forth in claim 15 further comprising tabs engaging the curved wall sections on opposite sides of the curved wall sections from sides positioned for engaging the chords and fixedly attached to the web, the tabs being positioned for resisting loads applied to the load bearing portions from the chord engaged by the load bearing portion.

* * * * *